US011753900B2

(12) United States Patent
Brackin et al.

(10) Patent No.: US 11,753,900 B2
(45) Date of Patent: Sep. 12, 2023

(54) ACTIVATION OF DOWNHOLE MECHANICAL DEVICE WITH INCLINATION AND/OR CHANGE IN RPM

(71) Applicant: Halliburton Energy Services, Inc., Houston, TX (US)

(72) Inventors: Van Jordan Brackin, Spring, TX (US); Jacob H. Kronman, Houston, TX (US); Curtis Clifford Lanning, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 319 days.

(21) Appl. No.: 16/933,820

(22) Filed: Jul. 20, 2020

(65) Prior Publication Data

US 2022/0018215 A1 Jan. 20, 2022

(51) Int. Cl.

| | |
|---|---|
| ***E21B 7/06*** | (2006.01) |
| ***E21B 34/06*** | (2006.01) |
| ***E21B 17/10*** | (2006.01) |
| *E21B 23/04* | (2006.01) |

(52) U.S. Cl.

CPC ..... *E21B 34/06* (2013.01); *E21B 7/06* (2013.01); *E21B 17/1085* (2013.01); *E21B 23/0421* (2020.05)

(58) Field of Classification Search

CPC ..... E21B 10/32; E21B 10/322; E21B 10/325; E21B 10/327; E21B 17/1014; E21B 21/103; E21B 7/06

See application file for complete search history.

(56) References Cited

U.S. PATENT DOCUMENTS

| | | | | |
|---|---|---|---|---|
| 4,721,172 | A * | 1/1988 | Brett | E21B 4/02 175/26 |
| 4,842,083 | A * | 6/1989 | Raney | E21B 10/43 175/408 |
| 6,009,945 | A * | 1/2000 | Ricks | E21B 43/123 166/151 |
| 8,365,843 | B2 | 2/2013 | Hall et al. | |
| 10,094,174 | B2 * | 10/2018 | Jain | E21B 10/08 |
| 2012/0199366 | A1 * | 8/2012 | Gaskin | E21B 34/14 175/57 |
| 2014/0246246 | A1 * | 9/2014 | Radford | E21B 10/322 166/332.3 |

(Continued)

*Primary Examiner* — Kipp C Wallace

(74) *Attorney, Agent, or Firm* — Barnes & Thornburg, LLP

(57) ABSTRACT

An activation control module utilizes gravity and/or centrifugal acceleration to move a mechanical element that controls, activates or deactivates a mechanical or hydraulic mechanism, for use with a downhole tool such as a drilling tool or reamer in a wellbore. In embodiments, the activation control module described herein may utilize a combination of centrifugal acceleration and/or gravity due to an inclination of the downhole tool to move a valve, which turns off pressure to a hydro-mechanical system. The activation control modules may be utilized in applications where very little space is available for larger mechanisms. Further, the activation control modules do not require expensive and complex electro-mechanical systems, reducing or eliminating the need for batteries, wiring, electronics, motors, pumps and the like. Moreover, the activation control modules described herein do not require the use of a turbine, a centrifugal clutch or a linear actuator.

16 Claims, 8 Drawing Sheets

(56) References Cited

U.S. PATENT DOCUMENTS

| | | | | |
|---|---|---|---|---|
| 2015/0322725 | A1* | 11/2015 | Fuller | E21B 34/06 175/269 |
| 2015/0354320 | A1* | 12/2015 | Mahajan | E21B 10/322 166/334.4 |
| 2016/0032658 | A1* | 2/2016 | Jain | E21B 17/1014 175/27 |
| 2017/0175455 | A1* | 6/2017 | Jain | E21B 10/62 |
| 2018/0106132 | A1* | 4/2018 | Griffith | E21B 37/00 |
| 2019/0178055 | A1* | 6/2019 | Deolalikar | E21B 10/322 |
| 2020/0040670 | A1* | 2/2020 | Snitkoff | F16K 31/44 |

* cited by examiner

ACTIVATION OF DOWNHOLE MECHANICAL DEVICE WITH INCLINATION AND/OR CHANGE IN RPM

BACKGROUND

The disclosure generally relates to controlling downhole devices in a well drilling completion operation for recovering hydrocarbon fluids. More specifically, the disclosure relates to a device and techniques for controlling position or behavior of downhole devices.

Actuation of downhole tools such as, e.g., drill bits or reamers by current methods often include dropping an activation ball from the surface or using mud pulse telemetry. In many of these applications, expensive and complex electro-mechanical systems may be required, or substantial space may be required to accomplish activation or deactivation control. Therefore, avoiding any of these limitations leads to an improved or less costly approach to actuate or control downhole tools in well drilling completion operation for recovering hydrocarbon fluids.

BRIEF DESCRIPTION OF THE DRAWINGS

Illustrative embodiments of the present disclosure are described in detail below with reference to the attached drawing figures, which are incorporated by reference herein, and wherein.

Figure 1:
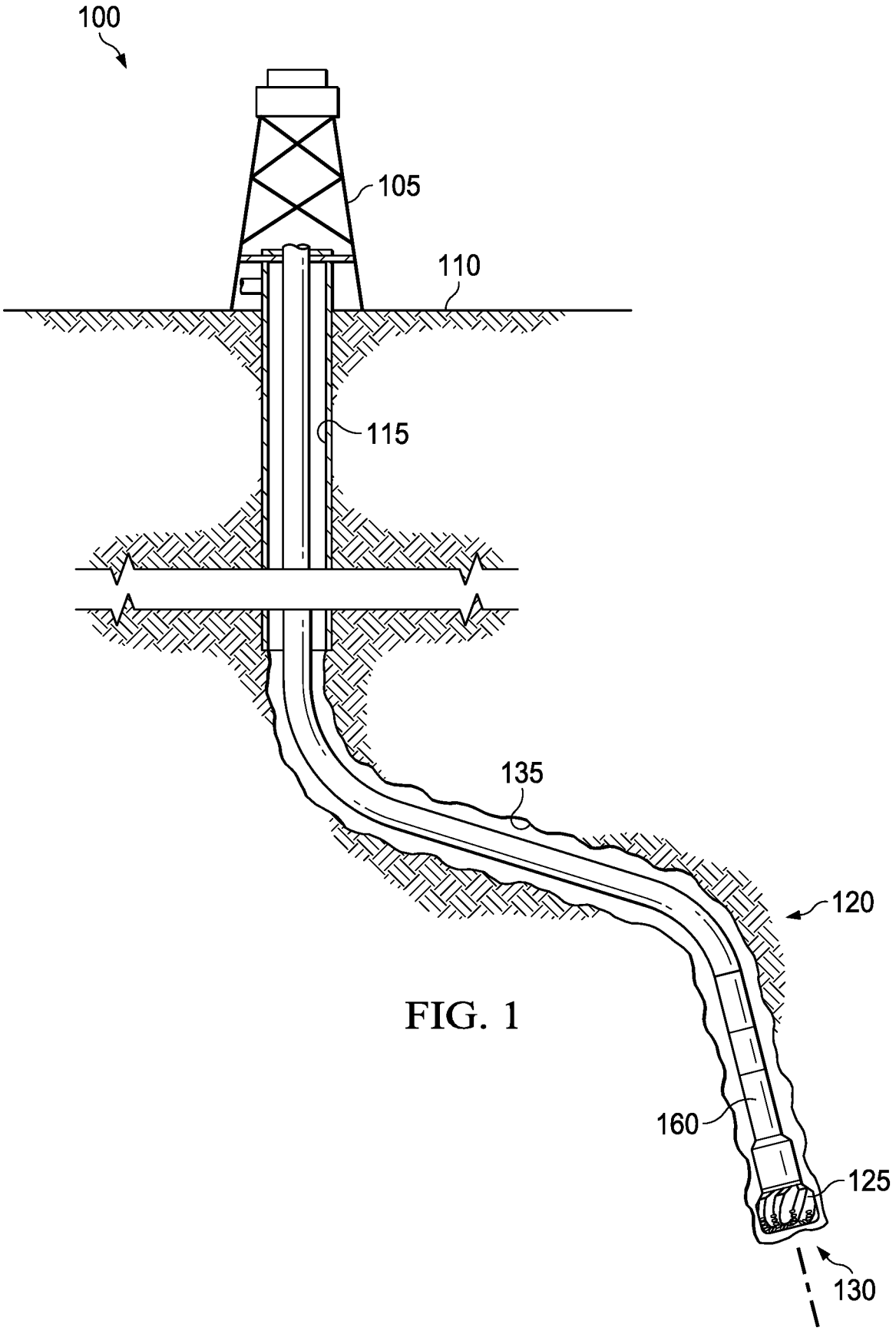
FIG. 1 is an illustration of a drilling string and downhole tool comprising a drilling tool for use with an activation control device, in accordance with principles of the disclosure.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the embodiments and figures are merely illustrative and do not imply that any particular step or component is a requirement of a claimed embodiment.

Unless otherwise specified, any use of any form of the terms connect, engage, couple, attach, or any other term describing an interaction between elements is not meant to limit the interaction to direct interaction between the elements and may also include indirect interaction between the elements described. In the following discussion and in the claims, the terms including and comprising are used in an open-ended fashion, and thus should be interpreted to mean including, but not limited to.

The various embodiments of an activation control module as described herein involve utilizing gravity and/or centrifugal acceleration to move a mechanical element that controls, activates or deactivates a mechanical or hydraulic mechanism, for use with a downhole tool. In embodiments, the activation control module described herein may utilize a combination of centrifugal acceleration and/or gravity due to an inclination of the downhole tool to move a valve, which turns-off or turns-on pressure to a hydro-mechanical system. As an example, lateral jarring of a downhole tool may be one of the events that causes the activation control module to activate a movable component thereby causing damping of vibrations or a change in movement of the downhole tool. The activation control modules may be utilized in applications where very little space is available for larger mechanisms. Further, the activation control modules do not require expensive and complex electro-mechanical systems, reducing or eliminating the need for batteries, wiring, electronics, motors, pumps and the like. Moreover, the activation control modules described herein do not require the use of one or more of a turbine, a centrifugal clutch and a linear actuator.

FIG. 1 is an illustration of a drilling string and downhole tool comprising a drilling tool for use with an activation control device, in accordance with principles of the disclosure, generally denoted as reference numeral 100. A drilling derrick 105 at surface 110 is shown positioned above a drilling string 160 having a downhole tool comprising a drilling tool 125 downhole at the lower end 130 of the drilling string 160 within wellbore 135. A well casing 115 has been placed at the uphole end of the wellbore 135. The wellbore 135 may have vertically oriented portions and horizontally oriented portions within geological formation 120. As will be explained in more detail in relation to FIGS. 3-8, a downhole tool such as drilling tool 125 can be controlled by an activation control device, which may be a part of the downhole tool to control cutting effectivity or wellbore orientation.

Figure 2:
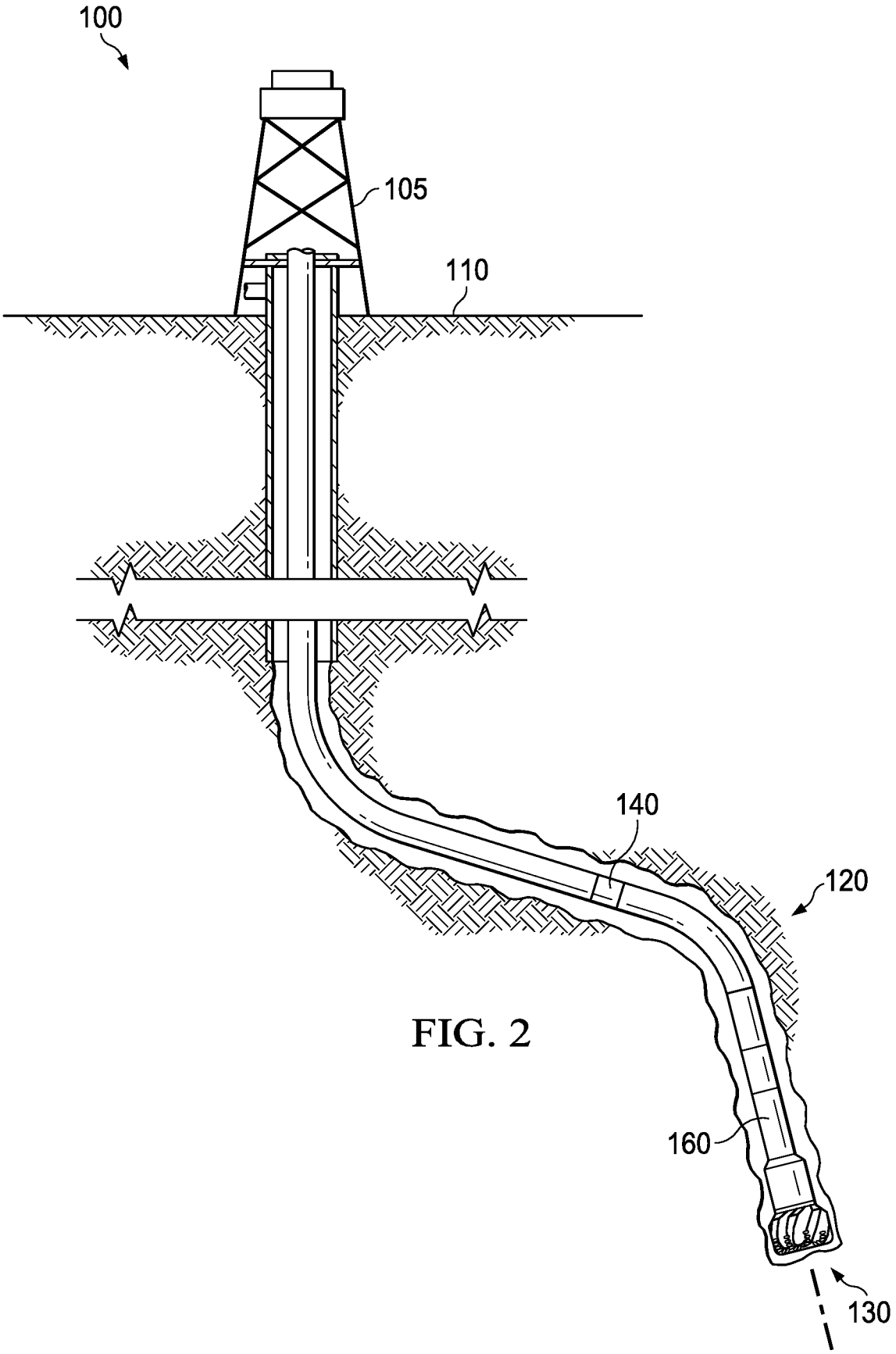
FIG. 2 is an illustration of a drilling string and downhole tool comprising a reamer and drilling bit for use with an activation control device, in accordance with principles of the disclosure.

FIG. 2 is an illustration of a drilling string 160 and downhole tool comprising a reamer 140 and drilling bit for use with an activation control device, in accordance with principles of the disclosure. The reamer 140 may be similarly controlled by an activation control device.

Figure 3:
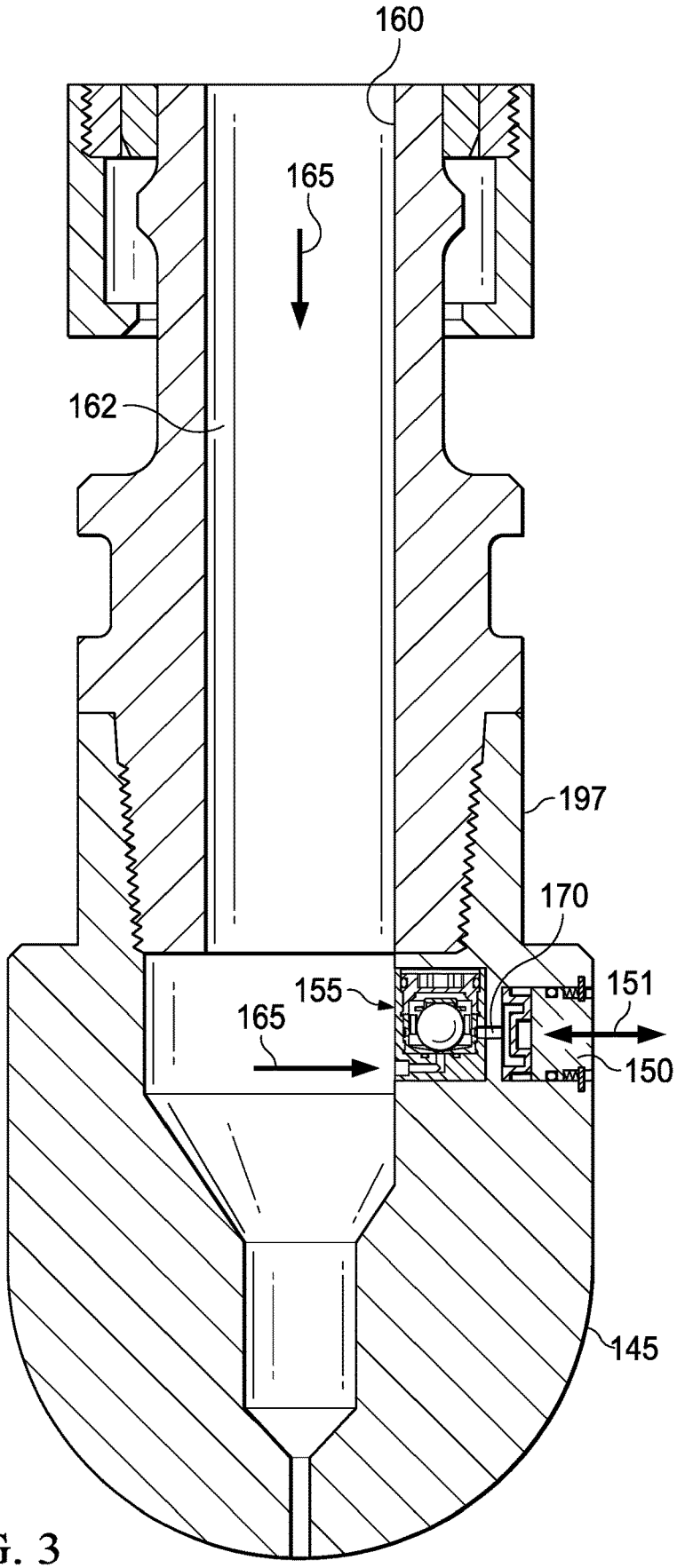
FIG. 3 is an illustration of a downhole tool controlled by an activation control device and gauge pad, in accordance with an embodiment of the disclosure.

FIG. 3 is an illustration of a downhole tool 197 controlled by an activation control device 155 and a moveable component such as a gauge pad 150, in accordance with an embodiment of the disclosure. Although a gauge pad is used as an example herein in the various embodiments herein, the moveable component is not limited to a gauge pad, rather may comprise other moveable components such as, e.g., a lateral moveable component, a deployable arm, a sleeve or other movable component for use with a downhole tool. The downhole tool 197 may be, for example, but not limited to, a drilling tool or a reamer. The downhole tool 197 is rotatable for boring a wellbore or for expanding a wellbore circumference, as examples. The downhole tool 197 may be positioned in a drill string 160, which may be at an end or between sections of the drilling string 160. Hydraulic pressure may be provided as mud flow 165 from the surface 110 for powering the downhole tool 197, and for powering the activation control device 155 and a movable component such as gauge pad 150. The activation control device 155 controls the position of the movable gauge pad 150 in normal operation. The movable gauge pad 150 is configured to be fully extendable from a non-extended state towards the outer diameter 145 of the downhole tool 145, which is also towards the wall of the wellbore 135, to be in an extended state. The movable gauge pad 150 is also configured to retract from the extended state to the non-extended state. The lateral movement of the gauge pad 150 perpendicular from a center axis of the downhole tool 197 of the gauge pad 150 is depicted by arrow 151.

In operation, the rotation of the drilling tool 197 may encounter one or more circumstances in the wellbore 135 including vibrations, jarring such as lateral jarring, exceeding a particular revolution-per-minute (RPM), or exceeding a particular angle from vertical to the surface 110. In one or more of these circumstances, embodiments of the activation control device 155 may permit the mud flow 165 from a passage 162 within the downhole tool 197 to flow to the gauge pad 150. This pressure of the mud flow 165 activates movement of the gauge pad 150 from the non-extended state to the extended state. In the extended state, the gauge pad 150 changes the behavior of the drilling tool 197, such as causing a change in inclination or RPM of the downhole tool. In the extended state, the gauge pad 150 presses against the surface of the wellbore 135 thereby causing a dampening effect.

Figure 4:
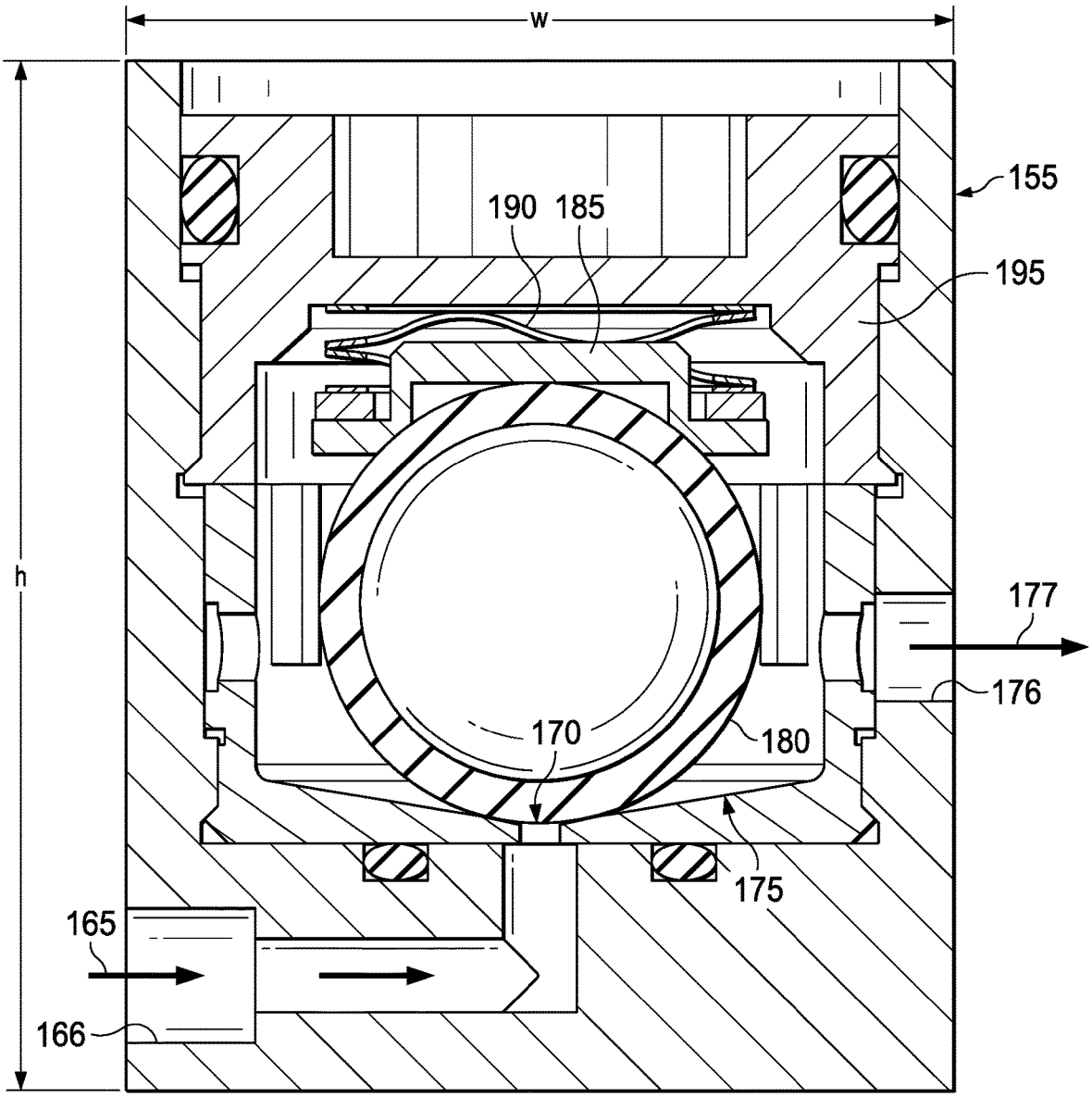
FIG. 4 is an illustration of an activation control device, in accordance with a preferred embodiment of the disclosure.

FIG. 4 is an illustration of an activation control device 155, in accordance with a preferred embodiment of the disclosure. The overall dimension of the activation control device 155 may be rather small. The height h may be about 1" and the width w may also be about 1." However, other dimensions are possible, and do not require a square configuration. Fluid pressure of mud flow 165 from the drilling tool 197 may enter the activation unit 155 via an inlet port 166 that is connected to an inlet aperture 170 of chamber 175. The chamber 175 has a slanted or conical base with an opening in the slanted or conical base at the inlet aperture 170 forming a check valve seat. A sealing ball 180, which may be coated with or made from an elastomer, is positioned within the chamber 175 proximate to the check valve seat and can move laterally within the chamber 175 under certain circumstances. An adjustable spring 190 presses against a top cap 185 that holds the sealing ball 180 within the chamber 175, and a top cap 195 that may hold the entire assembly in place. The adjustable spring 190 provides for altering a sealing force applied against the top cap 185 and the sealing ball 180. In operation, at low RPM, or lack of sufficient lateral jarring, the sealing ball acts as a check valve or a seal against the pressure at the inlet aperture 170 which acts as a check valve seat thereby preventing fluid flow 177 to the outlet port 176, which is connected to the gauge pad 150.

If, however, during operation the downhole tool 197 is sufficiently jarred, exceeds a predetermined inclination to vertical, or exceeds a predetermined RPM, the sealing ball 180 moves laterally within the chamber 175 along the slanted or conical base. This lateral movement permits mud flow past the sealing ball 180 into the chamber 175 and the outlet port 176 where the mud flow 177 pressure causes activation of the movable component, gauge pad 150. In this example, this activation of the gauge pad 150 causes movement laterally away from the downhole tool and causes a dampening effect on inclination and/or RPM of the downhole tool 197. Once any jarring stops, or the downhole tool 197 no longer exceeds a predetermined inclination to vertical, and no longer exceeds a predetermined RPM, the sealing ball 180 returns by gravity to the original sealing position at the apex of the slanted or conical base stopping fluid flow to the gauge pad 150. The gauge pad 150 may then return to a non-extended position since the fluid pressure has been removed and normal operation of the tool assists the gauge pad 150 back to the non-extended state when it contacts the wellbore surface.

Figure 5:
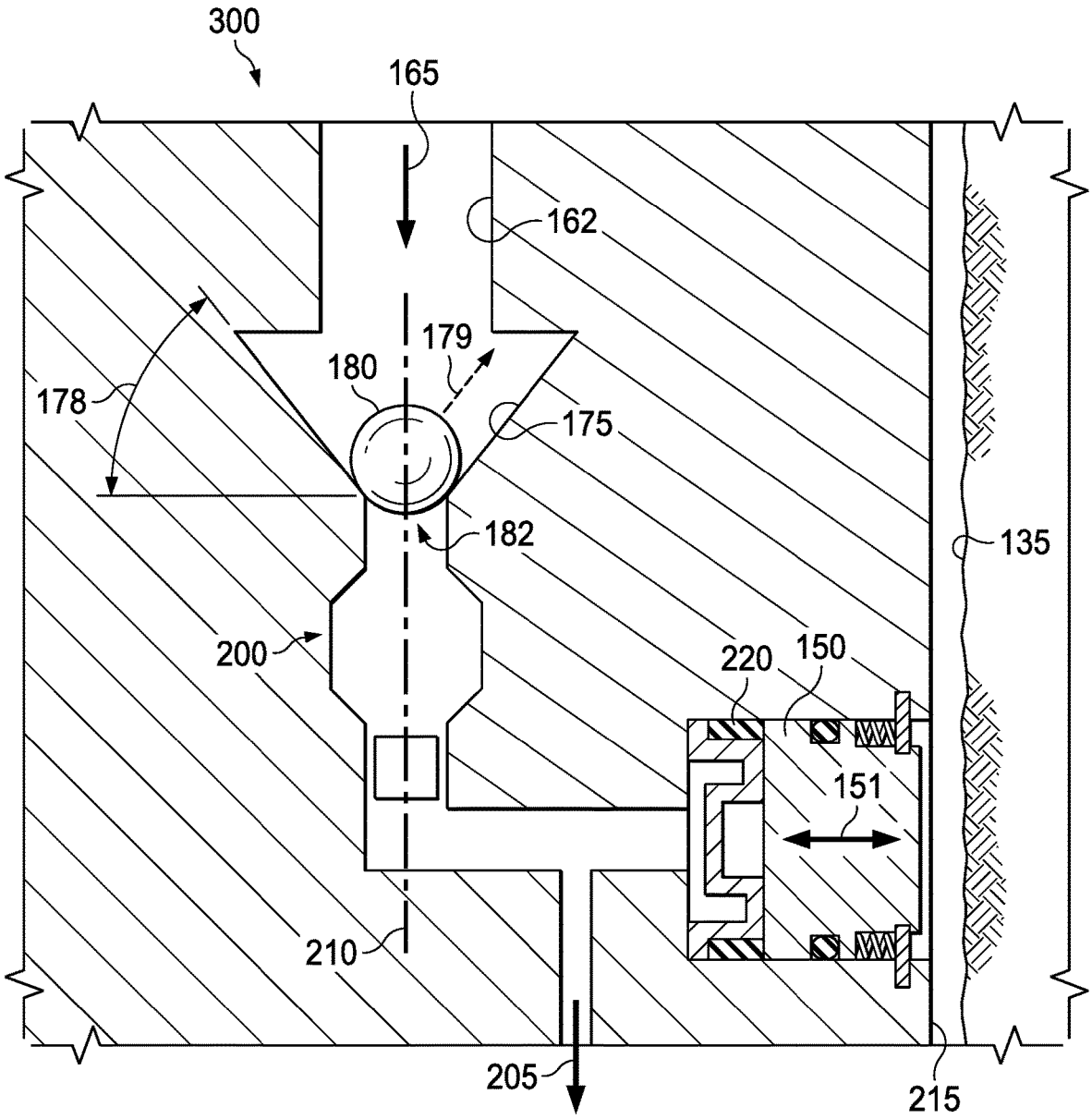
FIG. 5 is a generalized illustration of an activation control device and gauge pad, in accordance with an embodiment of the disclosure.

FIG. 5 is a generalized illustration of an activation control device 200 and a moveable component, gauge pad 150, in accordance with an embodiment of the disclosure, generally denoted by reference numeral 300. The activation control device 200 and gauge pad 150 may be configured within a downhole tool. In operation, pressure from mud flow 165 from the surface 110 through passage 162 within a downhole tool, e.g., tool 125, 140, 197, to a conically or slanted-wall shaped chamber 175 within activation control device 200. The chamber has a narrowed opening at the bottom forming an apex 182, or a check valve seat. A movable sealing ball 180 is positioned within the conically slanted-wall-shaped chamber 175 where the sealing ball 180 acts as a check valve and prevents passage of fluid flow out of the chamber 175 at the apex 182 or check valve seat, unless it is forced away from the apex 182 due to a jarring event, excessive RPM, excessive inclination, or similar force applied to the downhole tool. The sealing ball 180 is positioned proximate to the check valve seat so that the sealing ball can move within chamber 175 from a first position (seated) to a second positon (unseated) due to operational environment events. Proximate refers to the variable placement of the ball to permit the ball to be seated or unseated in the check valve based on operation events, that is, the ball can move from the first position to the second position and back again depending on operational events while remaining within chamber 175.

The angle 178 of the inner walls of the conically shaped or slanted-wall-shaped chamber 175 may be selected based on the intended application. The greater the angle 178, the greater the required energy for displacing the sealing ball from the apex 182. The angle of the conical side or slant-wall chamber may be predetermined to permit the sealing ball to move from the apex at a predetermined threshold of lateral shock experienced by the downhole tool.

Moreover, increasing the mass of the sealing ball 180 will also increase the energy required such as a lateral shock to displace the sealing ball from the apex 182, or check valve seat. Thus, greater the angle 178 or the increased mass of the sealing ball 180 translates to increased jarring, increased inclination to vertical, or increased RPM required to displace the sealing ball from the apex 182. As long as the sealing ball 180 remains aligned at the apex 182 and with the vertical centerline 210 of the downhole tool, essentially no mud flow will occur to the gauge pad 150. If operational use of the downhole tool is subject to sufficient jarring, exceeds a predetermined inclination to vertical 178, or sufficient RPM to force the sealing ball out of alignment with the centerline 210, the sealing ball will move 179 along the inner walls of the chamber 175 permitting mud flow past the apex 182. The mud flow 165 may then flow to and activate the moveable component such as gauge pad 150. This causes the gauge pad to move outwardly past the outer surface 215 of the downhole tool towards the wall of a wellbore 135 to change the direction or dampen RPM of the downhole tool. Pressure can bleed off through an outlet port 205 to permit the pressure to abate or to provide mud flow to a drilling tool downhole. The gauge pad may return to a non-expanded state in normal operation when jarring subsides, the predetermined inclination to vertical 178 is no longer exceed, and a predetermined RPM is no longer exceeded. Movement of the gauge pad is depicted by arrow 151.

Figure 6:
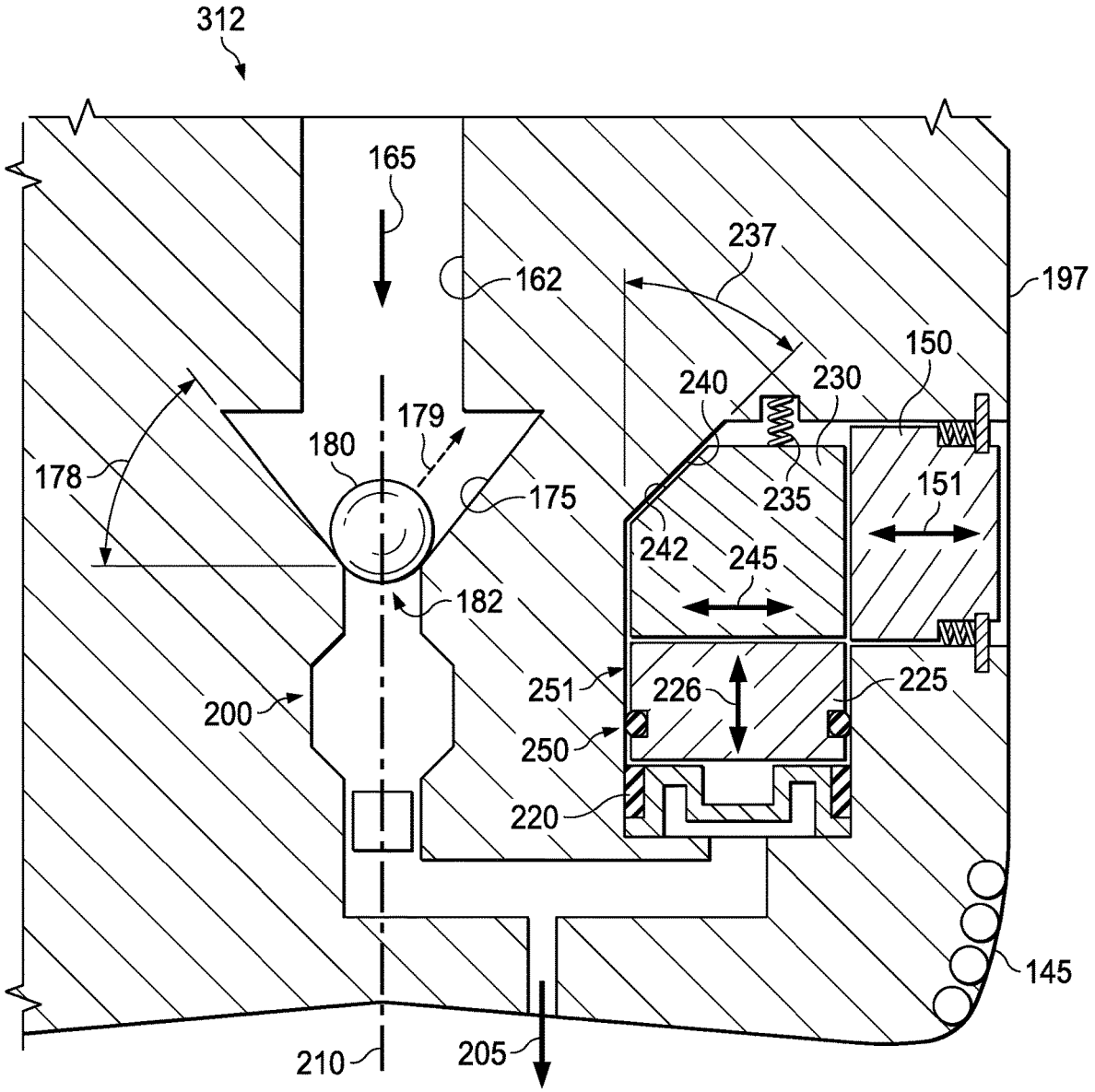
FIG. 6 is a generalized illustration of an activation control device and gauge pad, in accordance with an embodiment of the disclosure.

FIG. 6 is a generalized illustration of an activation control device 200 and moveable component, gauge pad 150, in accordance with an embodiment of the disclosure, generally denoted by reference numeral 312. The activation control device 200 and gauge pad 150 may be configured within a downhole tool. In operation, pressure from mud flow 165 from the surface 110 through passage 162 within a downhole tool, e.g., tool 125, 140, 197, to a conically or slanted-wall-shaped chamber 175 within activation control device 200. The chamber 175 has a narrowed opening at the bottom forming an apex 182 or check valve seat. A movable sealing ball 180 is positioned within the conically slanted-wall-shaped chamber 175 where the sealing ball 180 acts as a check valve and prevents passage of fluid flow out of the chamber 175 at the apex 182 or check valve seat, unless it is forced away from the apex 182 due to jarring, excessive RPM, excessive inclination, or similar force applied to the downhole tool.

The angle 178 of the inner walls of the conically shaped or slanted-wall-shaped chamber 175 may be selected based on the intended application. The greater the angle 178, the greater the required energy for displacing the sealing ball from the apex 182. Moreover, increasing the mass of the sealing ball will also increase the energy to displace the sealing ball from the apex 182. The greater the angle 178 or increased mass of the sealing ball 180 translates to increased jarring, increased inclination to vertical, or increased RPM required to displace the sealing ball from the apex 182. As long as the sealing ball 180 remains aligned or seated at the apex 182 and with the vertical centerline 210 of the downhole tool, no mud flow will occur to the gauge pad 150. If operational use of the downhole tool is subject to sufficient jarring, exceeds a predetermined inclination to vertical 178, or sufficient RPM to force the sealing ball out of alignment with the centerline 210, the sealing ball will move 179 along the inner walls of the chamber 175 permitting mud flow past the apex 182. The mud flow 165 may then flow to a gauge pad activator unit 250. The gauge pad activator unit 250 may comprise a housing 251 in which a floating piston 225 may move 226 within the housing 251 depending on the amount of pressure applied against the flexible mud seals 220. The floating piston 225 may press against a translating component 230 that has an angled wall 242 at a top end that is configured to slide against a like angled portion 240 at the top of the housing 251. The angle 237 may be preselected by design to give a particular rate of movement laterally. That is, different preselected angles 237 may give more aggressive movement or less aggressive movement of the translating component 230. Pressure supplied by the floating piston 225 against the translating component 230 may cause the translating component 230 to force the gauge pad 150 from a first position outwardly towards the inner surface of a wellbore 135. The sliding of the translating component 230 is depicted in part by arrow 245. There is also a vertical movement of the translating component 230. The outward movement of the gauge pad towards the wall of a wellbore 135 may change the direction or dampen RPM of the downhole tool. Pressure can bleed off through an outlet port 205 to permit the pressure to abate or to provide mud flow to a drilling tool downhole. The gauge pad may return to a non-expanded state (second positon) in normal operation when jarring subsides, the predetermined inclination to vertical 178 is no longer exceed, and a predetermined RPM is no longer exceeded. Movement of the gauge pad is depicted by arrow 151. A tensioning or spring mechanism 235 may be positioned to bias and return the translating component 230 towards the floating piston 225 such as to force the floating piston downwardly, or other direction as warranted. This also permits the gauge pad 150 to return to a non-expanded position when there is no longer sufficient jarring, the downhole tool no longer exceeds a predetermined inclination to vertical 178, and a sufficient RPM to force the sealing ball out of alignment with the centerline 210 is no longer present.

Figure 7:
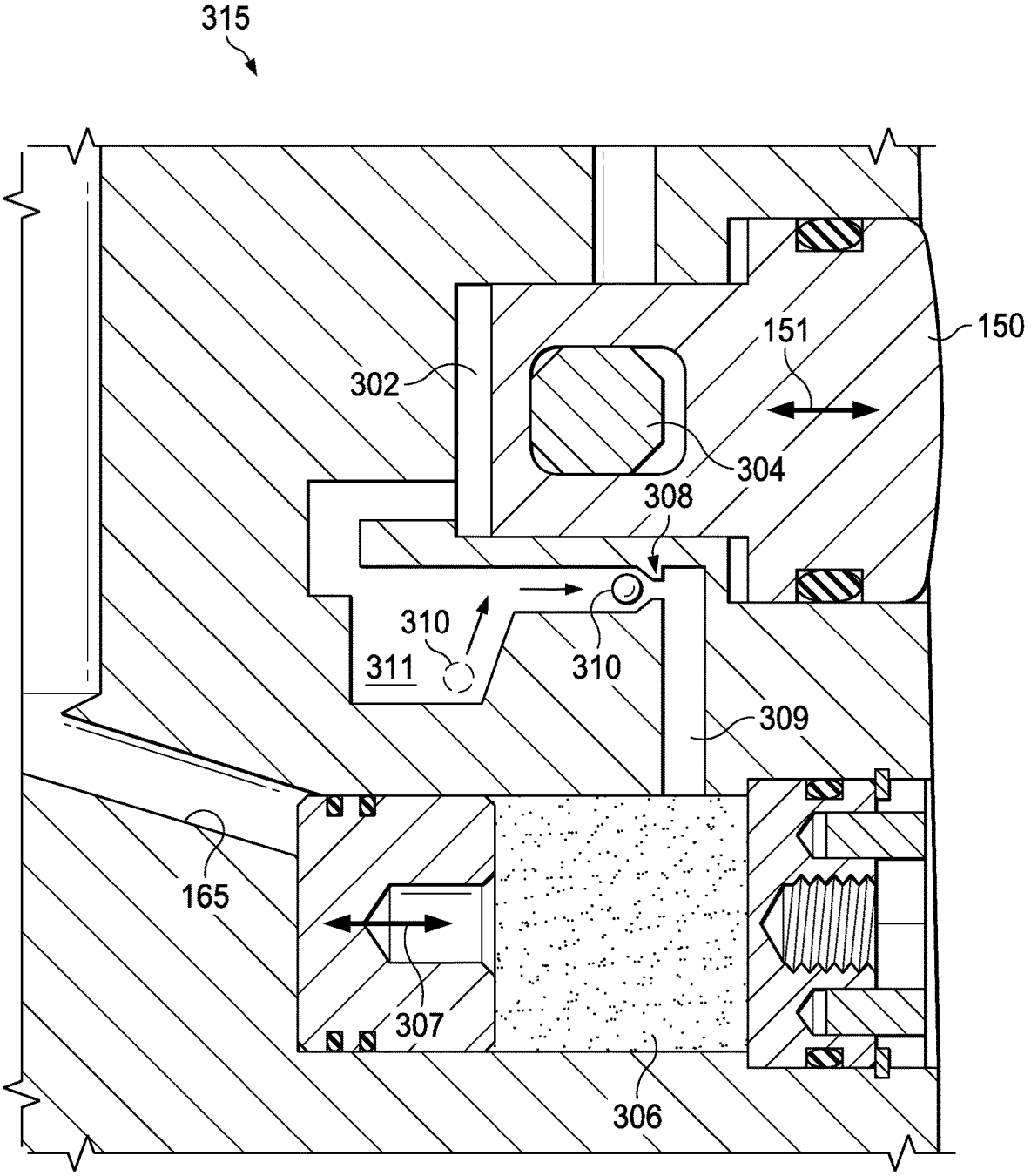
FIG. 7 is an illustration of an activation control device, in accordance with an embodiment of the disclosure.

FIG. 7 is an illustration of an activation control device, in accordance with an embodiment of the disclosure, generally denoted by reference numeral 315. The activation control device of FIG. 7 may be used in a downhole tool, e.g., tools 125, 140, 197, and may comprise a piston 307 that is driven by fluid pressure such as mud flow 165 from the surface 110 supplied to a downhole tool. The piston 307 can pressurize an oil-filled reservoir 306 that is in fluid communication via passageway 309 to a piston cavity 302. The piston cavity 302 of the activation control device is configured to drive a gauge pad 150 using the pressurized oil from the oil-filled reservoir 306 that moves 151 in relation to a guide post 304 that slideably holds the gauge pad 150 within the piston cavity 302. The passageway 309 is configured with a retainer portion 311 that forms a box-like compartment 311 positioned along passageway 309 between a check valve seat 308 and the piston cavity 302. The box-like compartment 311 is configured with an inclined wall. A sealing ball 310 is positioned within the passageway 309 between the check valve seat 308 and the piston cavity 302 so that in operation the sealing ball 310 can move from the box-like compartment 311 upwardly along the inclined wall to the check valve seat 308.

The moveable component of this example, gauge pad 150, has full movement at low inclinations and low RPMs of the downhole tool in which the activation control device is embodied. However, when the RPM, jarring or inclination of the downhole tool within the wellbore 135 exceed a predetermined amount, the movable component, gauge pad 150 activates. The free-floating ball may move within the box-like compartment 311 up the inclined wall into position at the check valve seat 308. That is the free-floating ball remains proximate to the check valve seat in the compartment 311 whether in a first position (seated) or a second positon (unseated). This acts as a check valve between the two cavities 302 and 306, trapping fluid in the piston cavity 302. This prevents the gauge pad 150 from being pushed back into the downhole tool resulting in the gauge pad 150 remaining closer to the outer diameter of the downhole tool and closer to the surface of the wellbore. This results in a reduction in the ability of the downhole tool to cut to the side in formation 120, which is a desirable feature in wellbore sections that require low dogleg severities, such as lateral sections of wells. The internal geometry of the box-like compartment 311 prevents the sealing ball 310 from moving at low inclinations and RPM due to gravity while allowing movement at higher values to establish the check valve function.

Figure 8:
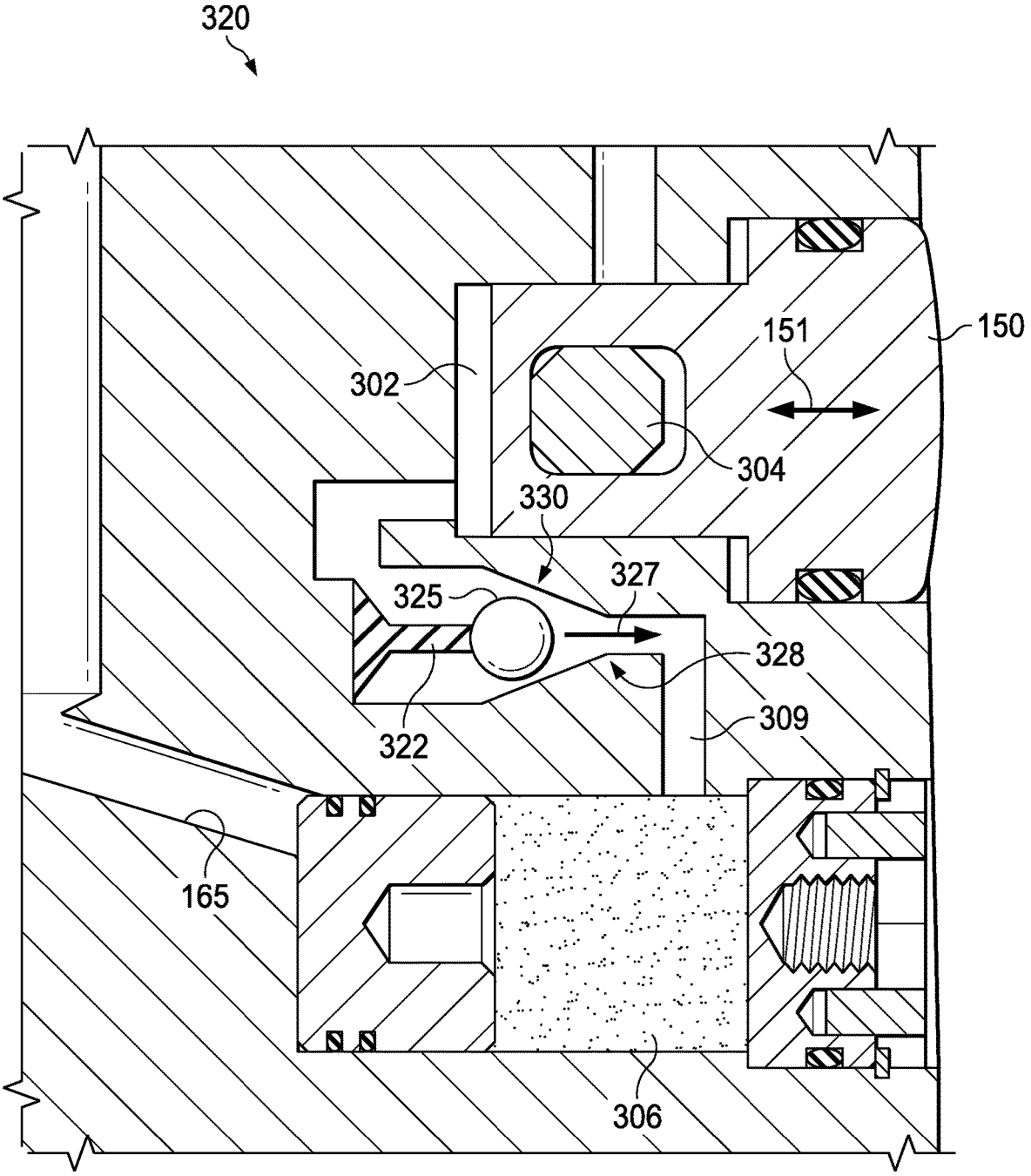
FIG. 8 is an illustration of an activation control device, in accordance with an embodiment of the disclosure.

FIG. 8 is an illustration of an activation control device, in accordance with an embodiment of the disclosure, generally denoted by reference numeral 320. The activation control device of FIG. 8 functions in a similar manner as the activation unit of FIG. 7, except the box-like compartment is replaced with a different compartment and the sealing ball is different. In FIG. 8, a conical-shaped compartment 330 with an opening at the apex of the conical shape is fluidly coupled to passageway 309 between the oil-filled reservoir 306 and the piston cavity 302. The conical-shaped compartment 330 is shown as being on its side, i.e., oriented radially, with the opening at the apex 328 of the cone connected to the passageway from the oil-filled reservoir 306. At the opposite end from the apex of the conical-shaped compartment 330, an elastic or elastomer retaining mechanism 322 that stretches, is also oriented radially and operates similar to a spring, is attached to a mass 325, which may be a ball. The conical-shaped compartment 330 also is fluidly coupled to the piston cavity 302 at the opposite end from the apex. At low RPM, the elastomer retaining mechanism 322 acts as a return spring to unseat the ball from the apex portion of the conical-shaped compartment 330. At higher RPM, the mass 325 pulls on the elastomer retaining mechanism 322 due to centrifugal force 327 and seats into the apex blocking fluid flow. The elastomer may be selected to give a desired spring rate. Likewise, the weight of mass 325 may be selected to give a desired pull effect. Seating RPM of the mass 325 into the apex of the conical-shaped compartment 330 may be selectively altered by controlling the radial position from the downhole tool centerline, spring rate and distance between the mass and the seating surface of the apex.

The advantage of the activation unit of FIG. 8 is that the operation is largely unaffected by inclination of the downhole tool and is active only during higher rotation of the downhole tool. This prevents the gauge pad 150 from being pushed back into the downhole tool resulting in the gauge pad 150 being closer to the outer diameter of the down hole tool and closer to the surface of the wellbore. This results in a reduction in the ability of the downhole tool to cut to the side in formation 120, which is a desirable feature in wellbore sections that require low dogleg severities, such as lateral sections of wells.

All of the embodiments of the activation control module herein may be sized to be 1" by 1" (+/−20%) in dimension, but the dimension may vary. The module may have a square shape or any other suitable shape, such as a rectangle shape or a trapezoid shape. All of the embodiments of the activation control modules herein may be utilized in applications where very little space is available for larger mechanisms. Further, the embodiments of the activation control modules do not require expensive and complex electro-mechanical systems, reducing or eliminating the need for batteries, wiring, electronics, motors, pumps and the like. Moreover, the activation control modules described herein do not require the use of a turbine, a centrifugal clutch or a linear actuator.

Further, although a gauge pad is used as an illustrative example of a movable component in the various embodiments of FIGS. 3-7, the moveable component is not limited to a gauge pad, rather may comprise other moveable components such as a lateral moveable component, one or more deployable arms, a sleeve or any other movable component for use with a downhole tool. The movable component may be moved as a result of a lateral shock event experienced downhole by a downhole tool such as hitting a solid formation element, the downhole tool deviating from vertical by a pre-determined amount, the downhole tool exceeding a predetermined RPM, or a combination thereof.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Various aspects of the disclosure may include the following:

Clause 1: An activation control device for use in a downhole tool, comprising:

a sealing ball movably positionable proximate to a check valve seat, the sealing ball and check valve seat positioned between a source of fluid pressure and a movable component, and the sealing ball and check valve seat forming a check valve that prevents the movable component from extending outwardly from the downhole tool during rotation when the sealing ball is seated in the check valve seat, and permits the movable component to activate by extending outwardly from the downhole tool during rotation when the sealing ball is unseated in the check valve seat.

Clause 2: The activation control device of clause 1, wherein the check valve seat is formed by an apex of a conically-shaped compartment, and the sealing ball moves from the apex as a result of the downhole tool exceeding a predetermined inclination from vertical, exceeding a predetermined revolution-per-minute (RPM) or experiences a lateral shock event to permit the fluid pressure to activate the movable component thereby causing damping of vibrations or a change in movement of the downhole tool.

Clause 3: The activation control device of clause 2, wherein the conically-shaped compartment has an angle of a conical side to a vertical centerline of the downhole tool and wherein the angle is predetermined to permit the sealing ball to move from the apex at a predetermined RPM of the downhole tool, the angle of the conical side is predetermined to permit the sealing ball to move from the apex at a predetermined deviation from vertical of the downhole tool, or the angle of the conical side is predetermined to permit the sealing ball to move from the apex at a predetermined threshold of lateral shock experienced by the downhole tool.

Clause 4: The activation control device of any one of clauses 1-3, wherein the check valve is aligned with a vertical centerline of the downhole tool.

Clause 5: The activation control device of any one of clauses 1-4, further comprising:

a fluid piston fluidly coupled between the check valve seat and the movable component; and a translation component positioned between the fluid piston and the movable component, wherein the fluid piston is activated by the fluid pressure when the sealing ball is unseated and the fluid piston exerts pressure against the translation component which exerts pressure against the movable component thereby causing the movable component to move.

Clause 6: The activation control device of clause 5, wherein the translation component is biased by a tensioning mechanism for moving the translation component towards the fluid piston when the sealing ball is seated.

Clause 7: The activation control device of any one of clauses 1-6, wherein the movable component is unable to support drilling forces and returns to a non-extended position when the sealing ball is in a seated position.

Clause 8: The activation control device of clauses 1-7, wherein the sealing ball and check valve seat are fluidly coupled between an oil filled reservoir and a piston cavity, and wherein the piston cavity coupled to the movable component for causing movement of the movable component.

Clause 9: The activation control device of clause 8, wherein the oil filled reservoir is pressurized by the source of fluid pressure and the oil filled reservoir provides the oil fluid to the piston cavity when the sealing ball is unseated from the check valve seat and stops providing the oil fluid to the piston cavity when the sealing ball is seated in the check valve seat, the sealing ball reaches the check valve seat to become seated due to reaching a predetermined RPM of the downhole tool, and becomes unseated when the revolution-per-minute (RPM) of the downhole tool is less than the predetermined RPM.

Clause 10: The activation control device of clause 9, further comprising an elastic retaining mechanism that retains the sealing ball radially in an unseated position until the predetermined RPM of the downhole tool is reached to become seated in the check valve seat thereby stopping flow of the oil fluid thereby preventing the movable component from moving.

Clause 11: The activation control device of clause 8, wherein the oil filled reservoir is pressurized by the source of fluid pressure and the oil filled reservoir provides the oil fluid to the piston cavity when the sealing ball is unseated from the check valve seat and stops providing the oil fluid to the piston cavity when the sealing ball is seated, the sealing ball traveling radially up an incline of a compartment to reach the check valve seat to become seated due to exceeding a predetermined deviation from vertical of the downhole tool.

Clause 12: The activation control device of any one of clauses 1-11, wherein the activation control device does not use of a turbine, a centrifugal clutch or a linear actuator.

Clause 13: The activation control device of any one of clauses 1-12, wherein the downhole tool is used in well drilling operations and the activation control device is part of the downhole tool.

Clause 14: The activation control device of any one of clauses 1-13, wherein the downhole tool comprises a drilling tool, and the movable component comprises a gauge pad or a reamer.

Clause 15: The activation control device of any one of clauses 1-14, wherein the activation device is about 1" by 1" in dimension.

Clause 16: A method for activation control of a downhole tool, comprising:

positioning a movably positionable sealing ball proximate to a check valve seat; and positioning the sealing ball and check valve seat between a source of fluid pressure and a movable component, the sealing ball and check valve seat forming a check valve that prevents the movable component from extending outwardly from the downhole tool during rotation when the sealing ball is seated in the check valve seat to affect revolution-per-minute (RPM), abate lateral shock or affect inclination of the downhole tool, and permits the movable component to activate by extending outwardly from the downhole tool during rotation when the sealing ball is unseated in the check valve seat.

Clause 17: The method of clause 16, further comprising:

coupling a fluid piston between the check valve seat and the movable component; and positioning a translation component between the fluid piston and the moveable component, wherein the fluid piston is activatable by the fluid pressure when the sealing ball is unseated so that the fluid piston exerts vertical pressure against the translation component which exerts pressure against the movable component to move the movable component outwardly from the downhole tool.

Clause 18: A method of activation control of a downhole tool, comprising:

causing rotation of a downhole tool and causing a sealing ball to unseat from a check valve seat, the sealing ball and check valve seat positioned between a source of fluid pressure and a movable component, the unseated sealing ball permitting the fluid pressure to flow to the moveable component to activate the movable component by moving from a first position to a second position during rotation to alter revolution-per-minute (RPM) of the downhole tool rotation or change an inclination of the downhole tool.

Clause 19: The method of clause 18, wherein the sealing ball unseats from the check valve seat due to the rotation exceeding a predetermined RPM, the downhole tool experiencing a jarring event, or the inclination of the downhole tool exceeding a predetermined inclination from vertical.

Clause 20: The method of clause 19, wherein the alteration in RPM, a reduction of the jarring event, or a change in inclination causes the sealing ball to seat in the check valve seat by gravity effect to stop the fluid pressure from flowing to the movable component thereby permitting the movable component to return to the first position.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. An activation control device for use in a downhole tool, comprising:

a sealing ball movably positionable proximate to a check valve seat, the sealing ball and check valve seat positioned between a source of fluid pressure and a movable component in a first position, and the sealing ball and check valve seat forming a check valve that prevents the movable component from extending outwardly, to a second position, from the downhole tool during rotation when the sealing ball is seated in the check valve seat to affect revolution-per-minute (RPM), abate lateral shock or affect inclination of the downhole tool, and permits the movable component to activate by extending outwardly from the downhole tool during rotation when the sealing ball is unseated in the check valve seat; wherein the alteration in RPM, a reduction of the lateral shock, or a change in inclination causes the sealing ball to seat in the check valve seat by gravity effect to stop the fluid pressure from flowing to the movable component thereby permitting the movable component to return to the first position.

2. The activation control device of claim 1, wherein the check valve seat is formed by an apex of a conically-shaped compartment, and the sealing ball moves from the apex as a result of the downhole tool exceeding a predetermined inclination from vertical, exceeding a predetermined revolution-per-minute (RPM) or experiences a lateral shock event to permit the fluid pressure to activate the movable component thereby causing damping of vibrations or a change in movement of the downhole tool.

3. The activation control device of claim 2, wherein the conically-shaped compartment has an angle of a conical side to a vertical centerline of the downhole tool, and wherein the angle of the conical side is predetermined to permit the sealing ball to move from the apex at a predetermined RPM of the downhole tool, the angle of the conical side is predetermined to permit the sealing ball to move from the apex at a predetermined deviation from vertical of the downhole tool, or the angle of the conical side is predetermined to permit the sealing ball to move from the apex at a predetermined threshold of lateral shock experienced by the downhole tool.

4. The activation control device of claim 1, wherein the check valve is aligned with a vertical centerline of the downhole tool.

5. The activation control device of claim 1, further comprising:

a fluid piston fluidly coupled between the check valve seat and the movable component; and a translation component positioned between the fluid piston and the movable component, wherein the fluid piston is activated by the fluid pressure when the sealing ball is unseated and the fluid piston exerts pressure against the translation component which exerts pressure against the movable component thereby causing the movable component to move.

6. The activation control device of claim 5, wherein the translation component is biased by a tensioning mechanism for moving the translation component towards the fluid piston when the sealing ball is seated.

7. The activation control device of claim 1, wherein the movable component is unable to support drilling forces and returns to a non-extended position when the sealing ball is in a seated position.

8. The activation control device of claim 1, wherein the activation control device does not use a turbine, a centrifugal clutch, or a linear actuator.

9. The activation control device of claim 1, wherein the downhole tool is used in well drilling operations and the activation control device is part of the downhole tool.

10. The activation control device of claim 1, wherein the downhole tool comprises a drilling tool, and the movable component comprises a gauge pad or a reamer.

11. The activation control device of claim 1, wherein the activation device is no larger than about 1" by 1" in dimension.

12. A method for activation control of a downhole tool, comprising:

positioning a movably positionable sealing ball proximate to a check valve seat; and positioning the sealing ball and check valve seat between a source of fluid pressure and a movable component in a first position, the sealing ball and check valve seat forming a check valve that prevents the movable component from extending outwardly, to a second position, from the downhole tool during rotation when the sealing ball is seated in the check valve seat to affect revolution-per-minute (RPM), abate lateral shock or affect inclination of the downhole tool, and permits the movable component to activate by extending outwardly from the downhole tool during rotation when the sealing ball is unseated in the check valve seat; wherein the alteration in RPM, a reduction of the lateral shock, or a change in inclination causes the sealing ball to seat in the check valve seat by gravity effect to stop the fluid pressure from flowing to the movable component thereby permitting the movable component to return to the first position.

13. The method of claim 12, further comprising:

coupling a fluid piston between the check valve seat and the movable component; and positioning a translation component between the fluid piston and the moveable component, wherein the fluid piston is activatable by the fluid pressure when the sealing ball is unseated so that the fluid piston exerts vertical pressure against the translation component which exerts pressure against the movable component to move the movable component outwardly from the downhole tool.

14. A method of activation control of a downhole tool, comprising:

causing rotation of a downhole tool and causing a sealing ball to unseat from a check valve seat, the sealing ball and check valve seat positioned between a source of fluid pressure and a movable component, the unseated sealing ball permitting the fluid pressure to flow to the moveable component to activate the movable component by moving from a first position to a second position during rotation to alter revolution-per-minute (RPM) of the downhole tool rotation or change an inclination of the downhole tool; wherein the sealing ball unseats from the check valve seat due to the rotation exceeding a predetermined RPM, the downhole tool experiencing a jarring event, or the inclination of the downhole tool exceeding a predetermined inclination from vertical; wherein the alteration in RPM, a reduction of the jarring event, or a change in inclination causes the sealing ball to seat in the check valve seat by gravity effect to stop the fluid pressure from flowing to the movable component thereby permitting the movable component to return to the first position.

15. The method of claim 14, further comprising:

coupling a fluid piston between the check valve seat and the movable component; and positioning a translation component between the fluid piston and the moveable component, wherein the fluid piston is activatable by the fluid pressure when the sealing ball is unseated so that the fluid piston exerts vertical pressure against the translation component which exerts pressure against the movable component to move the movable component outwardly from the downhole tool.

16. The method of claim 14, wherein the check valve is aligned with a vertical centerline of the downhole tool.

* * * * *